United States Patent [19]

Bertschi

[11] 4,327,753

[45] May 4, 1982

[54] HAIR-CURLING IMPLEMENT

[75] Inventor: Ernst Bertschi, Winterthur, Switzerland

[73] Assignee: ICOMAG Trust Reg., Vaduz, Liechtenstein

[21] Appl. No.: 202,235

[22] Filed: Oct. 30, 1980

[30] Foreign Application Priority Data

Oct. 31, 1979 [DE] Fed. Rep. of Germany ..... 2944050

[51] Int. Cl.[3] ..... A45D 2/00

[52] U.S. Cl. ..... 132/40; 132/34 R; 132/123

[58] Field of Search ..... 132/34 R, 34 A, 34 C, 132/39, 40, 41 R, 41 A, 41 B, 41 C, 33 R, 33 A, 33 B, 33 D, 123

[56] References Cited

U.S. PATENT DOCUMENTS

| | | | |
|---|---|---|---|
| 2,803,256 | 8/1957 | Lerner | 132/34 R |
| 3,140,719 | 7/1964 | Hansen | 132/123 |
| 3,161,202 | 12/1964 | Mecca | 132/40 |
| 3,275,007 | 9/1966 | Thackeray | 132/40 |
| 3,334,638 | 8/1967 | Behrens | 132/40 |
| 4,215,710 | 8/1980 | Sundin | 132/40 |

*Primary Examiner*—Robert A. Hafer

*Attorney, Agent, or Firm*—Karl F. Ross

[57] ABSTRACT

A hairdressing implement, especially a hair curler which can be electrically heated, comprises a handle from which a curling mandrel extends, this mandrel being provided with a plurality of combs each having a pivotal bar parallel to the mandrel axis and disposed in angularly equispaced relationship therearound so that a free space is provided to accommodate a heater. A sleeve through which the tines of the combs pass, is rotatable relative to the mandrel body to swing the tines beneath the surface of the sleeve to release the hair. Fingers adjacent the opening of the sleeve serve to cam the tines outwardly upon rotation in the opposite sense.

10 Claims, 3 Drawing Figures

HAIR-CURLING IMPLEMENT

FIELD OF THE INVENTION

My present invention relates to a hairdressing implement which can be used for curling hair and, more particularly, to a retractable-tooth or retractable-tine hair curler which can be electrically heated.

BACKGROUND OF THE INVENTION

It is known to provide, for beauty salon (professional) and home use, hair-curling implements which may be electrically heated to facilitate the setting of a curl formed by engagement of a tuft of hair in the teeth or tines of an implement having a mandrel or body from which the teeth extend and about which the tuft of hair is coiled by rotation of the implement via a handle or grip fixed to one end of the mandrel or curling body. When the tuft of hair is subjected for a sufficient period of time to the heat, it tends to retain its curled position and the implement can be withdrawn from the curl, e.g. by retraction of the teeth or tines, these words being used interchangeably to refer to projections of any shape from the body which can engage the hair.

In one class of hair curlers with retractable teeth (see U.S. Pat. No. 2,803,256 and German Pat. No. 711,723) the teeth are formed on generally flat combs which extend parallel to the longitudinal axis of the implement and are received in slits or slots of a coiling body or mandrel while camming means of the inclined ramp type are provided to enable the combs to be drawn inwardly into the interior of this mandrel and hence permit the teeth to be lowered flush with or below the outer surface of the mandrel in disengaging from the teeth. The camming means is activated by a slider or pushbutton device and in the retracted positions, the combs occupy practically the entire interior of the mandrel so that the latter cannot accommodate a heating rod satisfactorily.

In another approach to the problem, illustrated for example in U.S. Pat. No. 3,148,685, combs are provided on opposite legs of a hairpin-shaped member so that they are normally biased outwardly through slots in the surface of the coiling mandrel, the shanks being depressible inwardly through appropriate windows to retract the teeth.

Here again, since the combs lie generally in radial planes and are retracted by movement in these planes, in their retracted positions they occupy a large portion of the interior of the mandrel and preclude the installation of a heating body therein. In this case, as in the case of the system mentioned previously, the heating of the curler, if desired, is very complex.

Still another hair curler is described in U.S. Pat. No. 3,275,007 in which the aforedescribed problems are eliminated by utilizing a different approach for disengaging the teeth from the hair, for shifting the teeth into a inoperative position.

In this construction, the teeth are pivotal relative to the mandrel and reach inwardly to engage an axially shiftable body so that the latter can be moved to swing the teeth from upstanding positions into positions in which the teeth hug the outer surface of the mandrel. While this arrangement can leave the central portion of the device free to accommodate a heating unit, hair may be pinched between the recumbent teeth and the outer surface of the curling mandrel.

OBJECTS OF THE INVENTION

It is, therefore, the principal object of the present invention to provide an improved hair curler which can be readily disengaged from a complete curl, whereby the disadvantages of the systems described above are obviated.

Another object of the invention is to provide a hair curler having a comparatively large number of retractable teeth which, upon retraction, do not obstruct the interior of the unit so that the latter may accommodate the heating element.

It is also an object of the invention, in a hair curler of the improved class described, to facilitate retraction without danger of clamping the hair between the teeth and the body upon which the teeth are movable.

It is still another object of the invention to provide a hair curler which can have comparatively long teeth and nevertheless which will allow the teeth to be fully retracted below the curling surface.

SUMMARY OF THE INVENTION

These objects and others which will become apparent hereinafter are attained in accordance with the present invention, in a hair curler having an elongated curling body provided with a plurality of angularly spaced combs each of which has its teeth mounted upon a pivot rod, each pivot rod being journaled on the body for rotation about arespective axis generally parallel to the axis of the body and corresponding to the longitudinal axis of the rod.

The pivot rods are enclosed in a sleeve which is rotatable relative to the body which can be tubular to accommodate an electric heater. The sleeve is provided with throughgoing openings through which the teeth can project and with edges flanking these openings which serve to draw the teeth inwardly below the outer surface of the sleeve and cam the teeth outwardly through the openings when the teeth are to be extended.

Advantageously, the teeth are arcuate with a curvature toward their free ends in the sense of rotation of the sleeve for extension of the teeth.

From the foregoing it will be apparent that the tubular body of the curler, which accommodates an electric heating rod, and the sleeve rotatable therearound to extend or retract the teeth, define an annular compartment win which the teeth are accommodated when they are retracted, below the surface of the sleeve.

Advantageously, the openings can be provided with inwardly bent fingers of the sleeve for engagement with the free ends of the fully retracted teeth to cam them outwardly through the openings downstream of these fingers in the direction of rotation of the sleeve for tooth excursion from the openings.

Since the rows of teeth on combs are pivotal on respective rods about the axes thereof in an array around the curler tube, a comparatively large number of rows of teeth can be provided without obstructing the interior, i.e. without impeding the ability to insert a heating element in the tube.

The actuating sleeve, with comparatively slight rotation, can shift all of the teeth into and out of the retracted position without significant resistance when each opening is provided with a finger of the aforedescribed type and all of the teeth are curved in the same sense.

Because the teeth are completely retracted into the aforementioned compartment, the curler can be withdrawn from the warm curl without distorting the curl so that the latter retains its shape and there is no danger that hair will be clamped between the tooth and the surface of the curler.

The curved teeth also facilitate twisting the curler to form the curl and promote the inward and outward camming actions mentioned previously.

The tube which forms the body of the curler of the present invention is formed with angularly equispaced outwardly open grooves to accommodate the rods and with circumferential grooves to receive the teeth when the latter are retracted into the compartment. Advantageously, the ungrooved lands of the tube or body can lie along the inner surface of the sleeve to form a heat transfer member between the heater within the tube and the sleeve in contact with the hair.

The rotary sleeve can be fixed to a journaling cap which is rotatable relative to the handle and the rotation of the sleeve and/or the tube body relative to the sleeve can be limited by a stop pin and/or indexing means for retaining the sleeve relative to the body in one or both of the limiting positions of the sleeve.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figure 1:
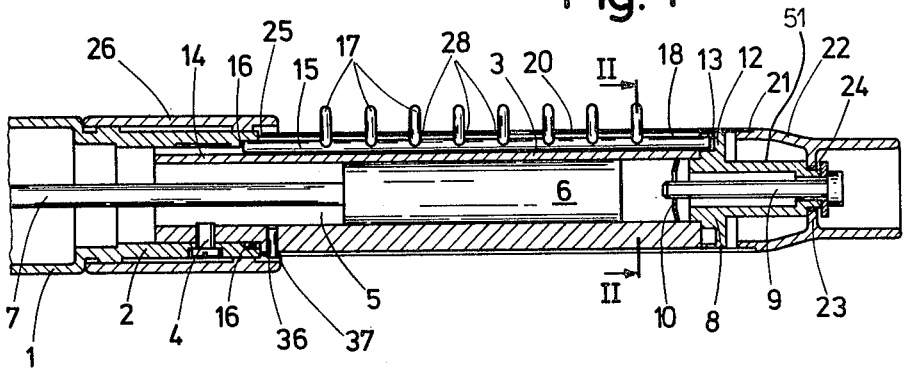
FIG. 1 is a longitudinal (axial) cross-sectional view through a portion of a hair curler according to the invention.

The hair curler shown in the drawing (for the dry-setting of hair) comprises a handle or grip 1 which is formed with a tubular extension 2 in which is fitted a curler tube or body 3 and held against rotation by a set screw 4. In the interior space or hollow 5 of the tube 3 there is fitted an electrical heating element in the form of a rod 6 which has a cable 7 connecting to the current supply network.

Upon the open end of the tube 3 there is mounted a rotatable cap 6 which is held in place by a locking spring 10 of disk configuration and a screw 9.

This journal cap 7 abuts via a disk 12 against the free end of the tube 3 and forms a journal ring 13 in which the ends of the pivot rods 15 project. The opposite ends of pivot rods 15 are of circular cross section, project into spaces between the extension 2 and the plug-like formation 14 of the tube 3 received therein.

The pivot rods thus run parallel to the axis of the hair curler and to each other and are swingable about respective longitudinal axes.

Each of the pivot rods 15 carries a multiplicity of curler teeth 17 lying in a respective row.

In the preferred and best mode embodiment illustrated, each rod 15 lies in a row of notches or grooves 18 of trough shape (FIGS. 2 and 3) aligned along a generatrix of the body 3.

Figure 2:
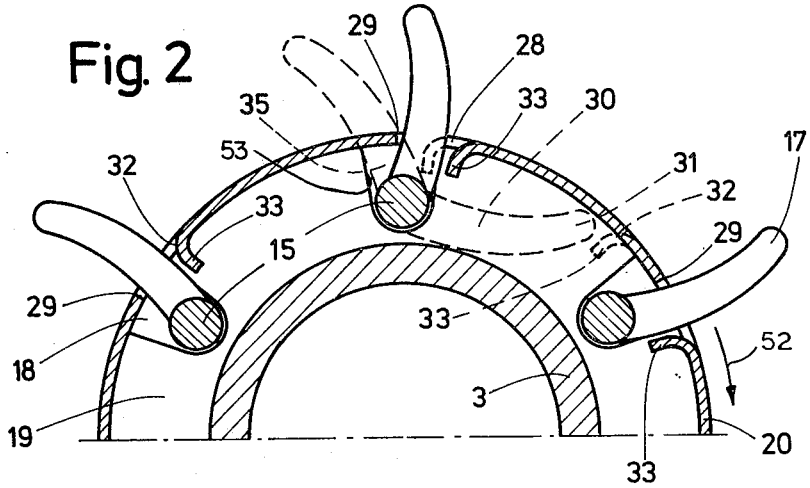
FIG. 2 is a section along the line II-II of FIG. 1.
Figure 3:
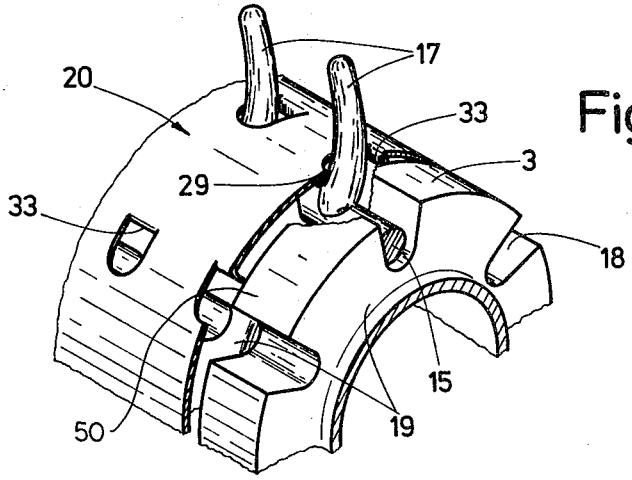
FIG. 3 is a detail perspective view drawn to a larger scale showing the cooperating relation between one of the tooth bars and the tube body of the invention.

To receive the teeth 17, the tubular body 3 is also formed with annular (circumferential) grooves 19 which are deeper than the troughs 18 and can fully accommodate the teeth as is shown in broken line at 30 in FIG. 2.

The tube 3, thus fitted with the pivot rods 15, which form combs with the respective array of teeth, is surrounded by an actuating sleeve 20 which lies directly in contact with the lands 50 between the grooves 19 and troughs 18 so that direct heat transfer is provided by the metallic and heat conductive sleeve 3 from the heating rod 6 to the sleeve 20 which contacts the hair of the user.

The sleeve 20 also extends over the disk 12 so that it can be anchored to a rotating grip or handle 22 which has a cap configuration and reaches over the boss 51 of disk 12. An inner guide ring or flange 23 is fixed in a groove 24 of member 51 against axial movement but rotatably so that the sleeve 20 can be rotated in both senses relative to the tube 3.

The opposite end of sleeve 20 is represented at 25 and terminates close to the free end of the extension 2 in the region of which it is enclosed by a protective sleeve 26.

For each of the teeth 17, the sleeve 20 is provided with a throughgoing opening 28 which has a width in the direction of rotation which is somewhat greater than the thickness of the tooth adapted to be accommodated therein.

By rotation of the sleeve 20, the teeth can be swung outwardly into their working position as shown in solid lines in FIG. 2. Rotation of the sleeve 20 in the opposite sense (arrow 52), however, brings the edge 29 of each opening against the concave surface of the respective tooth to cam the latter into the campartment formed in each groove 19 between the sleeve 20 and the floor of this groove (broken line showing of tooth 30 in FIG. 2)

In this latter position, all of the teeth lie wholly within the sleeve and the free ends 31 thereof do not project from the openings 28.

If it is desired to extend the teeth from such retracted positions, the sleeve 20 is rotated in the opposite sense (counterclockwise in FIG. 2) so that inwardly directed fingers 33 on the opposite side of the opening 28 form the edges 29, engage the free ends 31 and cam the teeth outwardly. The fingers 33 thus represent broadened camming surfaces.

Because the openings 28 have a somewhat greater width than the corresponding dimension of the teeth, the teeth may be movable within these openings. It is thus advantageous to swing the teeth until they are held against the flank 53 of the trough 18 by the finger 33 as shown for the broken line tooth 35. The fingers 33 must, of course, be smaller than the grooves 19 so as not to prevent rotation of the sleeve 20.

The movement of the sleeve relative to the tube 3 is limited by a stop pin 36 anchored in the body 3 and engaging a peripheral slot 37 of appropriate length in the sleeve 20. The pin thus represents indexing means for fixing the limiting positions of the sleeve. Spring-loaded ball-type indexing means may also be provided, if desired, to prevent accidental displacement of the sleeve from its limiting positions.

The hair curler can be used easily and is of inexpensive construction. When the teeth are erect, the drive is used in the same manner as any other hair curler and once the curl is formed, the teeth are retracted and the unit withdrawn from the curl. In the retracted position of the teeth, the device has a practically smooth surface which does not hinder withdrawal from the curl.

Obviously, the invention is not limited to the best embodiment illustrated and it is possible to provide, instead of individual windows 28 for each tooth, elongated slots forming a common window for all of the teeth of a given comb. The pivot rods 15 need not be journaled in troughs over their full lengths and can be simply held pivotally at their ends. The teeth of individual rows can be turned toward one another or away from one another although best results are obtained when they are all turned in the same sense, i.e. are convex opposite the direction of their rotation into the erect positions.

Naturally it is also possible to provide the rotating member as the body 3 if the sleeve 20 is held against rotation and to use a single grip instead of the two grips or handles described. The teeth need not be rigid or of solid configuration but can be formed by bundles of bristles. When the teeth are elastic or deflectible, the fingers should be correspondingly formed so as to be able to cam the teeth out of the openings.

I claim:

1. A hair curler comprising:

a handle;

a tubular body mounted on said handle and extending therefrom while having an axis and being adapted to receive a heating element;

a plurality of combs formed with respective pivot rods disposed about the periphery of said body and rotatable relative thereto, each of said combs having an array of teeth spaced therealong; and a sleeve surrounding said body and said rods and formed with windows enabling said teeth to be erected through said windows upon relative rotation of said sleeve and said body in one sense and to be retracted to lie between said sleeve and said body upon relative rotation of said sleeve and said body in an opposite sense.

2. The hair curler defined in claim 1 wherein said windows are provided with camming edges engaging said teeth upon relative rotation of said sleeve and said body in opposite sense.

3. The hair curler defined in claim 2 wherein said sleeve is formed with a respective throughgoing opening accommodating each tooth, said openings forming said windows.

4. The hair curler defined in claim 3 wherein one of said edges is formed by an inwardly directed caming finger on said sleeve engageable with each of said teeth.

5. The hair curler defined in claim 4 wherein said teeth are arcuate and are convex in the direction of displacement of said teeth from retracted positions to erect positions.

6. The hair curler defined in claim 5 wherein said body is formed with circumferential grooves receiving said teeth in said retracted positions.

7. The hair curler defined in claim 6 wherein said body is formed with lands between said grooves directly contacting said sleeve and in heat-conductive relation therewith.

8. The hair curler defined in claim 5 wherein said sleeve is provided with a cap at an opposite end of said sleeve from said handle for rotating said sleeve.

9. The hair curler defined in claim 5, further comprising stop means for limiting rotation of said sleeve relative to said body in erect and retracted positions of said teeth.

10. The hair curler defined in claim 9 wherein said stop means includes a pin fixed to said body and engaged in a slot of said sleeve.

* * * * *

UNITED STATES PATENT AND TRADEMARK OFFICE

Certificate

Patent No. 4,327,753 Patented May 4, 1982

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Ernst Bertschi and Samuel Gimelli.

Signed and Sea led this sixteenth day of September, 1986.

BRADLEY R. GARRIS,
*Office of the Deputy Assistant Commissioner for Patents.*

REEXAMINATION CERTIFICATE (394th)

United States Patent [19]

Bertschi

[11] B1 4,327,753

[45] Certificate Issued Oct. 1, 1985

[54] HAIR-CURLING IMPLEMENT

[75] Inventor: Ernst Bertschi, Winterthur, Switzerland

[73] Assignee: ICOMAG Trust Reg., Vaduz, Liechtenstein

Reexamination Request:
No. 90/000,569, Jun. 4, 1984

Reexamination Certificate for:

| | |
|---|---|
| Patent No.: | **4,327,753** |
| Issued: | **May 4, 1982** |
| Appl. No.: | **202,235** |
| Filed: | **Oct. 30, 1980** |

[30] Foreign Application Priority Data

Oct. 31, 1979 [DE] Fed. Rep. of Germany ..... 2944050

[51] Int. Cl.[4] ..... A45D 2/00

[52] U.S. Cl. ..... 132/40; 132/33 R; 132/34 R; 132/39; 219/222; 132/37 R; 132/123

[58] Field of Search ..... 132/11 R, 31, 33 R, 132/9, 40, 42, 39; 219/222

[56] References Cited

U.S. PATENT DOCUMENTS

| | | | |
|---|---|---|---|
| 2,244,068 | 6/1941 | Kay | 132/31 |
| 4,368,376 | 1/1983 | Andis | 219/222 |

FOREIGN PATENT DOCUMENTS

| | | |
|---|---|---|
| 2224591 | 11/1973 | Fed. Rep. of Germany . |
| 2551508 | 5/1977 | Fed. Rep. of Germany . |

*Primary Examiner*—Gregory McNeill

[57] ABSTRACT

A hairdressing implement, especially a hair curler which can be electrically heated, comprises a handle from which a curling mandrel extends, this mandrel being provided with a plurality of combs each having a pivotal bar parallel to the mandrel axis and disposed in angularly equispaced relationship therearound so that a free space is provided to accommodate a heater. A sleeve through which the tines of the combs pass, is rotatable relative to the mandrel body to swing the tines beneath the surface of the sleeve to release the hair. Fingers adjacent the opening of the sleeve serve to cam the tines outwardly upon rotation in the opposite sense.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-10 is confirmed.

New claim 11 is added and determined to be patentable.

*11. A hair curler comprising:*

*a handle;*

*a tubular body mounted on said handle and extending therefrom;*

*said tubular body being provided with heating means;*

*a plurality of combs formed with pivot rods disposed about the periphery of said tubular body and rotatable relative thereto, each of said combs having an array of teeth spaced therealong;*

*a sleeve rotatably surrounding said tubular body and said rods and formed with openings for receiving said teeth upon relative rotation between said sleeve and said tubular body in one direction and for retracting said teeth upon relative rotation between said sleeve and said tubular body in the opposite direction;*

*said body and said sleeve being disposed in heat transfer relationship; and*

*said body being formed with recess means for receiving said teeth to lie between said sleeve and said body in the retracted position while maintaining said sleeve and said body in heat transfer relationship.*

* * * * *